US005359758A

United States Patent [19]

Stahlecker et al.

[11] Patent Number: 5,359,758

[45] Date of Patent: Nov. 1, 1994

[54] PROCESS AND AN ARRANGEMENT FOR THE PIERCING OF A SLIVER

[76] Inventors: Fritz Stahlecker, Josef-Neidhart-Strasse 18, 7347 Bad Überkingen; Hans Stahlecker, Haldenstrasse 20, 7334 Süssen, both of Germany

[21] Appl. No.: 871,127

[22] Filed: Apr. 20, 1992

[30] Foreign Application Priority Data

Jul. 3, 1991 [DE] Germany ..... 4121980

[51] Int. Cl.[5] ..... D04H 1/16; D01H 11/00; D01G 25/00

[52] U.S. Cl. ..... 28/117; 28/104; 28/141; 19/150; 57/261

[58] Field of Search ..... 57/261, 263, 281, 90; 19/159; 28/103, 104, 107, 116, 117, 140, 141

[56] References Cited

U.S. PATENT DOCUMENTS 3,312,050 4/1967 Noguera ..... 57/90
4,033,104 7/1977 Kamp ..... 57/90
4,939,895 6/1990 Raasch et al. ..... 57/90
4,969,323 11/1990 Stahlecker ..... 57/90
4,982,563 1/1991 Stahlecker ..... 19/159 A

FOREIGN PATENT DOCUMENTS 3802413 8/1989 Germany .
1015780 1/1966 United Kingdom .

*Primary Examiner*—Clifford D. Crowder
*Assistant Examiner*—Larry D. Worrell
*Attorney, Agent, or Firm*—Evenson, McKeown, Edwards & Lenahan

[57] ABSTRACT

In the case of a process for the piecing of the starting portion of a new sliver to the end portion of a sliver travelling into a spinning arrangement, it is provided that the starting portion and the end portion of the sliver are overlapped, placed on a transport belt and loaded by means of a skid. A movable servicing device is provided for selectively moving the skid to accommodate the piecing.

17 Claims, 5 Drawing Sheets

Fig. 3
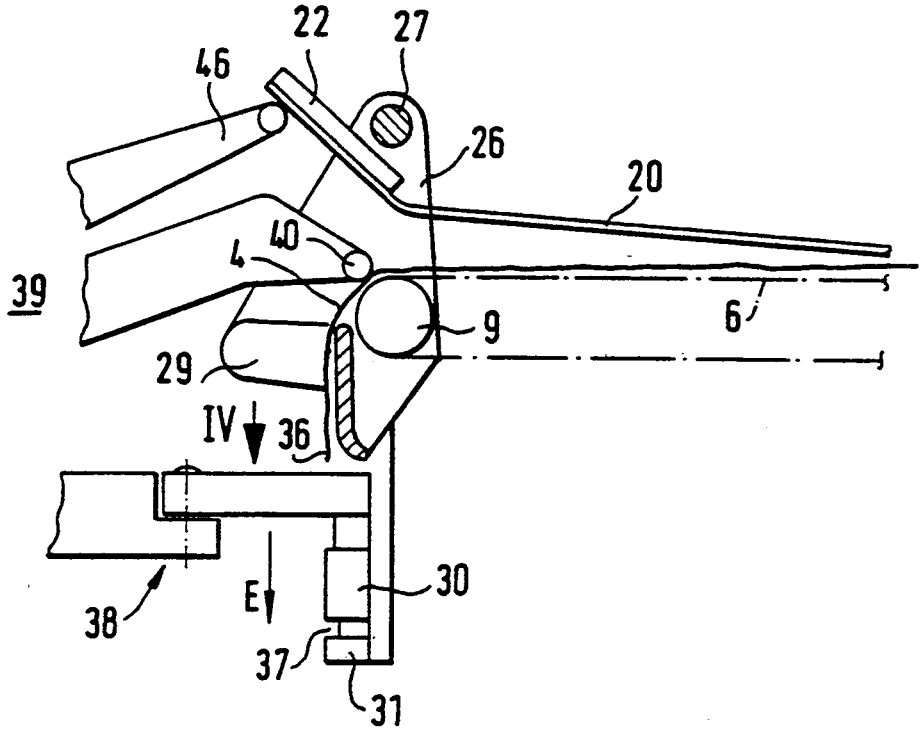
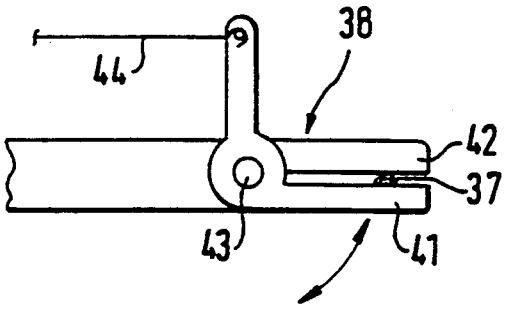
Fig. 4

PROCESS AND AN ARRANGEMENT FOR THE PIERCING OF A SLIVER

BACKGROUND AND SUMMARY OF THE INVENTION

This invention relates to a process and an arrangement for the piecing of the starting portion of a new sliver to the end portion of a sliver travelling into a spinning arrangement, the starting portion and the end portion of these slivers being connected with one another in an overlapping and supported manner.

A process of this type is the state of the art on the basis of the German Patent Document DE 38 02 413 A1. Devices are arranged stationarily for the supporting of the entering sliver in the overlapping area. The starting portion and the end portion of the sliver must therefore be connected with one another sufficiently tightly, for example, by pneumatic bombarding, so that the connected sliver, which is pulled over the stationary supporting device by the delivery device of the spinning unit, is not drafted or even torn.

On the basis of the British Patent Document GB-PS 10 15 780, which does not address the connecting of two slivers, it is known, in the case of a ring spinning machine, to transport the slivers fed in cans from the cans to the spinning stations by means of two transport belts. In this case, the slivers are in each case clamped between two transport belts.

It is an object of the invention to avoid the danger of faulty drafts in the case of two slivers that are to be connected with one another, specifically also when the connection is not made to be particularly tight.

This object is achieved according to preferred embodiments of the invention in that the slivers in the overlapping area are placed on a transport belt and are loaded by means of a skid.

As a result of the fact that the starting portion and the end portion of the slivers in the overlapping area are placed on a transport belt, the supporting device is also movable and no speed difference exists between the starting portion and the end portion of the slivers. This excludes faulty drafts. As a result of the fact that furthermore the slivers are loaded by means of a skid, the connecting point of the slivers is ironed out and in the process receives a sufficient adherence so that, also after leaving the transport belts, the connecting point is sufficiently tight.

In an advantageous development of the invention, it is provided that the starting portion and the end portion of the slivers are rendered pointed. This advantageously takes place by the fact that the starting portion and the end portion of the slivers are clamped and drawn, in which case a residual portion is cut off. As a result, thick points can be avoided in the overlapping area while, in addition, the described advantages are maintained.

It is expediently provided that the end portion of the sliver, after having been made pointed, is secured at a given position. This is particularly expedient if the connection of the slivers is carried out by means of automatic devices which find the end portion of the sliver in a predetermined position In an advantageous development of the invention, the skid can be lifted off the transport belt in the overlapping area. As a result, the starting portion of the new sliver can easily be placed on the end portion of the sliver travelling into the spinning arrangement. After the lowering of the skid, the overlapping point will then be strengthened.

Expediently, a deflecting guide for the transport belt is provided in the overlapping area. This deflecting guide may be a part of a clamp by means of which the sliver is clamped for providing the end portion with a point.

In an advantageous development of the invention, an actuating device of a movable piecing arrangement is provided which is assigned to the overlapping area. By means of this actuating device, the skid for the inserting of the new sliver can be lifted, on the one hand, while, on the other hand, the starting portion and the end portion of the slivers can be overlapped by means of automatic devices.

Other objects, advantages and novel features of the present invention will become apparent from the following detailed description of the invention when considered in conjunction with the accompanying drawings.

BRIEF DESCRIPTION OF THE DRAWINGS

FIG. 3 is a partial view of FIG. 2 in the area of the entering of the transport belt, the end portion of the sliver which is provided for entering into the spinning arrangement being prepared by automatic devices;

FIG. 4 is a partial view of a sliver clamp in the direction of the arrow IV of FIG. 3;

DETAILED DESCRIPTION OF THE DRAWINGS

Figure 1:
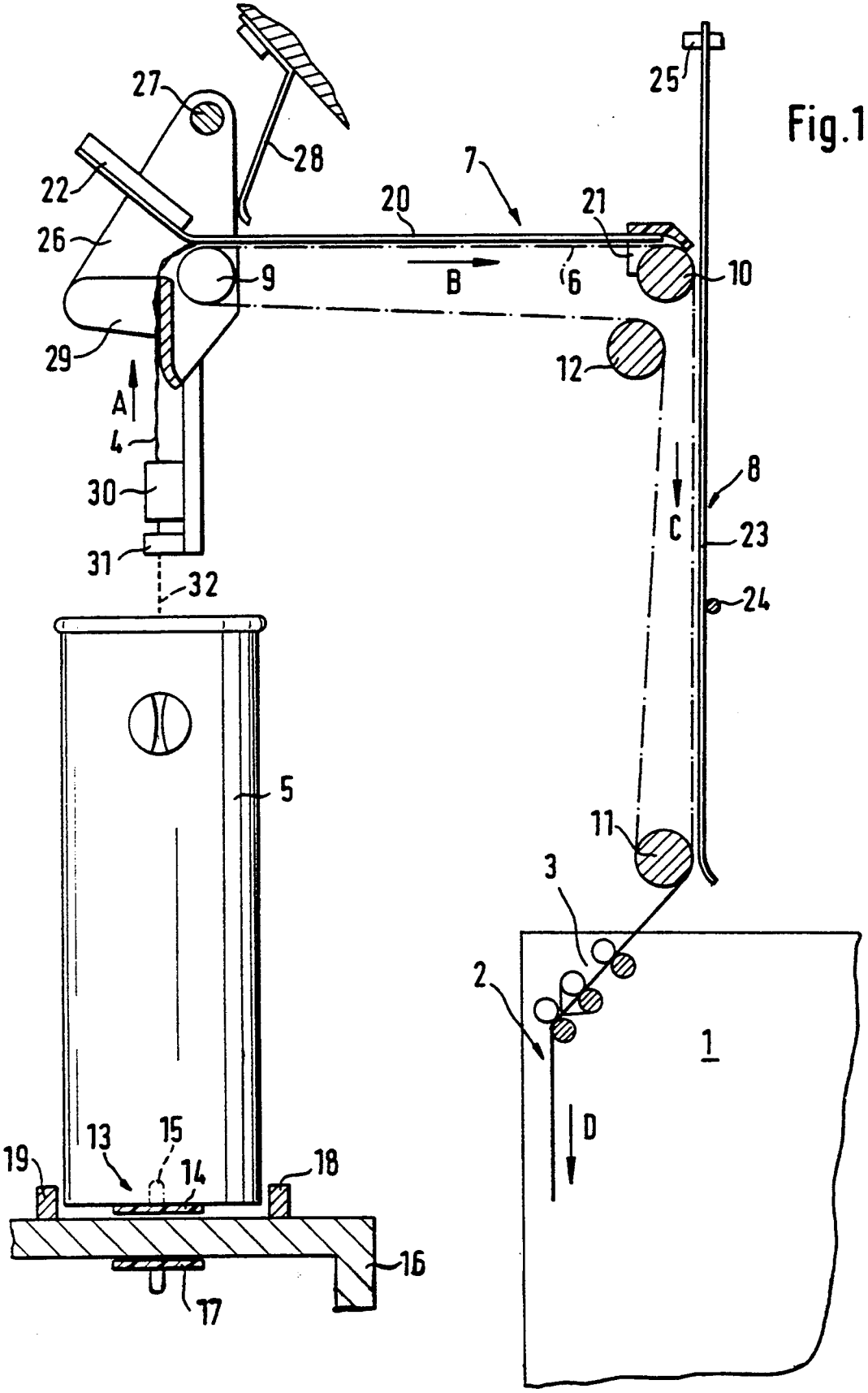
FIG. 1 is a partially sectional partial view in the area of a can and of a transport belt loaded by a skid before a can exchange, constructed according to a preferred embodiment of the invention.

FIG. 1 is an only schematic view of a spinning machine 1 which comprises a plurality of spinning stations 2 arranged next to one another on each side of the machine. Only a drafting unit 3 constructed as a three-cylinder drafting unit is shown of each spinning station.

Each spinning station 2 is used for the spinning of a sliver 4 which has, for example, a size of from Nm 0.3–0.8. The slivers 4 to be spun are fed in cans 5. A transport belt 6, which is indicated by a dash-dotted line and has an angular construction and comprises an essentially horizontal run 7 and a vertical run 8, is used for guiding the slivers 4 from the cans 5 to the spinning stations 2. The transport belt 6 is guided by a total of four deflecting rollers 9, 10, 11 and 12. The deflecting rollers 10 and 12, which are closely adjacent to one another, extend along at least one machine section. Deflecting roller 11 is disposed on a drivable shaft extending through in the longitudinal direction of the machine. Deflecting roller 9 is a separately constructed tension roller.

The transport belts 6 are constructed to be so wide that during the operation there is sufficient space for two slivers 4 disposed next to one another. The slivers 4 to be spun are withdrawn from the pertaining can 5 in the direction of the arrow A, are then guided to the drafting units 3 in the direction of the arrows B and C, and, after the drafting, are fed in the direction of the arrow D to a twist-providing element, which is not shown, such as a ring spindle or a wind-around spindle or an air nozzle.

A depositing site 13 is assigned to each can 5 during the operation. In this case, several, for example, three or four rows of cans 5 may be set up next to one another along the spinning machine 1. The set-up sites 13 are situated on a transport belt 14 which extends in the longitudinal direction of the spinning machine 1 and which comprises not only the set-up sites 13 but is also used for exchanging the cans 5 that were spun empty for filled new cans 5. The transport belts 14, which are provided with take-along devices 15 engaging in the recessed bottoms of the cans 5, slide over a platform 16 under which the returning run 17 of the transport belt 14 is guided. Guide rails 18 and 19 are used for the lateral guiding of the cans 5 during the transport.

In the horizontal run 7, the transport belts 6 which are disposed next to one another in the longitudinal direction of the spinning machine 1 are each covered by a skid 20. The skid 20 extends essentially between the deflecting rollers 9 and 10 and rests preferably with its own weight on the pertaining transport belt 6 and the pertaining slivers 4. By means of a stop 21 which rides on the deflecting roller 10, the skid 20 is supported against the deflecting roller 10 in the transport direction B. By means of a grip lever 22, the skids 20, in a manner that will be described below, as may be required, can be lifted off the deflecting roller 9 situated above the can 5.

Also in the vertical run 8, a skid 23 is provided which is pressed slightly against the transport belt 6 by means of a rod 24 extending in the longitudinal direction of the machine. The vertical skid 23 is fastened in a suspension device 25 above the deflecting roller.

The tension rollers 9 are each arranged in a holder 26 which can be swivelled about a stationary shaft 27 under the pressure of a loading spring 28 in such a manner that the transport belt 6 is sufficiently tensioned. On its side facing the can 5, the holder 26 carries a sliver guide 29 which is used for the lateral guiding of the respective sliver 4 when it travels onto the transport belt 6.

Measures were taken to avoid that the respective can 4 will not run empty of the sliver 4 to be spun. This may be achieved by the fact that the cans 5 will always be exchanged for newly filled cans 5 before the sliver 4 runs out. For this purpose, it is useful to recognize the filling condition of the respective can 5. This may, for example, take place by assigning to each can 5 a preferably optical not shown signal generator which stops the spinning machine 1 in time, for example, by checking the residual weight.

Subsequently, the running-out old end portion of the sliver 4 is preferably cut. For this purpose, a clamping device 30 is provided between the sliver guide 29 and the pertaining can 5, and a cutting device 31 is assigned to this clamping device 30. The cutting device 31 cuts off the end portion of the old sliver 4 so that the remainder 32, which is shown by an interrupted line, falls back into the can 5 and in a later stage can be returned to the process. By means of the clamping device 30, the end portion of the old sliver 4 can be secured at a predetermined point.

Figure 2:
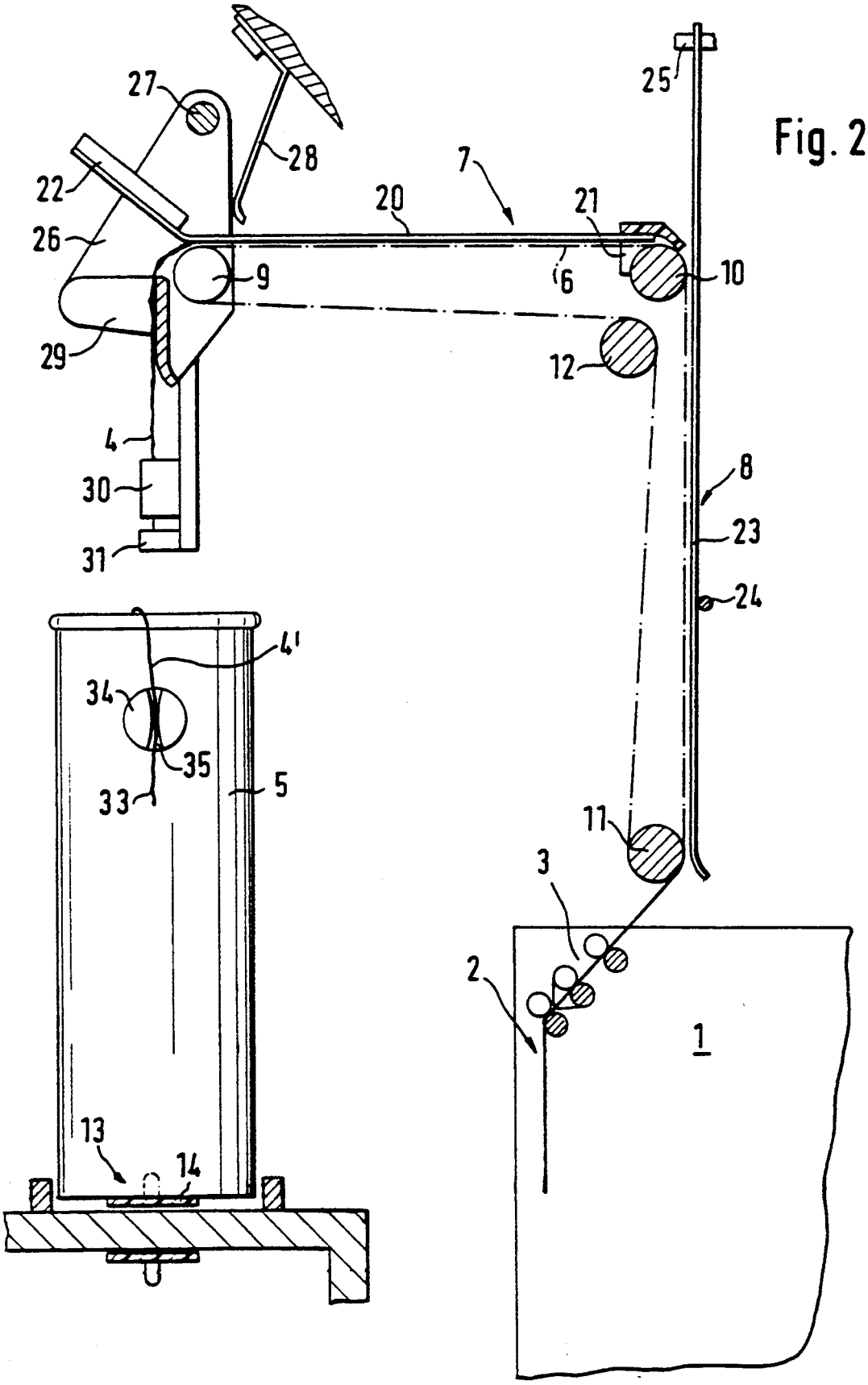
FIG. 2 is a partial view according to FIG. 1 after a can exchange.

The representation according to FIG. 2 shows the condition in which a can 5 containing the cut-off remainder 32 of the sliver 4 was removed by means of the transport belt 14 and a newly filled can 5' with a new sliver 4' was guided to the set-up site 13. In this case, it is provided that the cans 5 which were spun empty are exchanged in blocks for at least one side of the machine for filled cans 5'.

In the case of the new cans 5', the starting portions 33 of the new slivers 4' are secured on the respective can 5', specifically by means of a clamping device 34. This clamping device 34 may, for example, be a plastic part which has a narrow longitudinal slot 35. The starting portion 33 of the new sliver 4' will then hang down on the side of the can 5' and may be gripped for the connection with the end portion of the old sliver 4. This may take place by an operator or by a movable piecing arrangement.

The invention is based on the recognition that rubbed or pneumatically connected slivers 4 and 4' are difficult to draft in the drafting unit 3. By means of the transport belt 6, it becomes possible to not make the connecting point of the end portion 36 of the old sliver 4 (see FIG. 3) with the starting portion 33 of the new sliver 4' particularly strong. The reason is that the transport belt 6 has the result that the slivers 4, 4' are not subjected to any significant tensile stress in the connecting area.

For a precise drafting in the drafting unit 3, it is best for two well prepared end portions 36 and 33 of slivers 4 and 4' to be placed above one another. The preparation may take place in that—as shown at the end portion 36 of the old sliver 4—, by means of a clamping device 38 of a movable piecing arrangement 39, a sliver portion 37 is again cut off by drafting so that a prepared end portion 36 is obtained. For this purpose, the old sliver 4 resting on the transport belt 6 is pressed by means of a pusher 40 of the movable piecing arrangement 39, for example, against the deflecting roller 9. Subsequently, the sliver clamp 38 can grip the old end portion 37 of the sliver 4 and pull it down in the direction of the arrow E so that at 36 a tapering end portion of the old sliver 4 is created which will be described below. In this case, as illustrated in FIG. 4, the sliver clamp 38 may be composed of two tong arms 41 and 42 which can be moved about a joint 43 under the effect of a tension device 44 and of a spring which is not shown so that the end 37 of the old sliver 4 to be cut off can be clamped between the tong arms 41 and 42.

Figure 5:
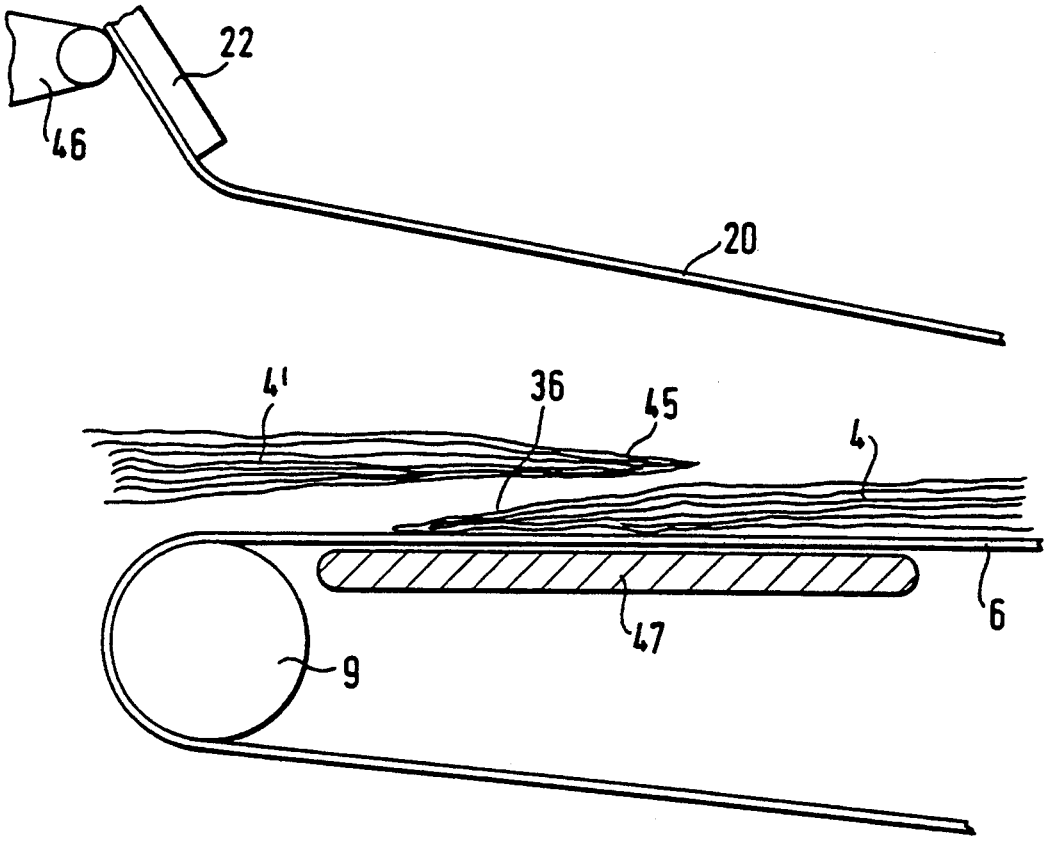
FIG. 5 is an enlarged representation of the overlapping area of the starting portion and the end portion of two slivers to be connected.

For the old sliver 4, a prepared sliver end portion 36 is created which tapers, as indicated in FIG. 5.

The starting portion 33 of the new sliver 4' may be prepared by similar measures in a manner that is not shown so that, for the new sliver 4', an end portion 45 is created which is also prepared and which tapers (see also FIG. 5).

For inserting the end portion 45 of the new sliver 4' on the transport belt 6, the skid 20, as illustrated in FIG. 3, can be lifted slightly off the transport belt 6 by means of the grip-type end piece 22, for example, by means of an actuating device 46 of the movable piecing arrangement 39.

For the piecing of the starting portion 45 of a new sliver 4' to the end portion 36 of a sliver 4 entering into a spinning station 2 (see FIG. 5), the two prepared end portions 45 and 36 are placed above one another. Then the previously lifted-off skid 20 is caused to fall back onto the overlapping area of the slivers 4, 4' so that the prepared starting portions and end portions 45, 36 are pressed together transversely. When the transport belt 6 is now started, the slivers 4 and 4' are ironed in the overlapping area so that an adhesion of the connecting point is achieved which is sufficient for an entering into the drafting unit 3. It is therefore not necessary to rub or twist the connecting point together. A precise placing of the starting portion 45 of the new sliver 4' onto the end portion 36 of the old sliver 4 is sufficient.

It is expedient to support the transport belt 6 in the area of the overlapping point by means of a rail 47.

The invention permits a connecting of the slivers 4 and 4' while maintaining a very good parallel position of the individual fibers. This results in a good drafting in the drafting unit 3.

In a manner which is not shown, the skid 20, as required, may temporarily be slightly loaded after being placed on the overlapping area of the slivers 4, 4', for example, by means of a loading element of the piecing arrangement 39. This results in a stronger pressing-together of the starting portion 45 with the end portion 36 in the transverse direction. When, in addition, a groove-type recess is provided in the skid 20 which corresponds to the width of the sliver 4, 4', a certain rounding effect is also achieved during the pressing-together.

There is no danger that the relatively sensitive transport belt 6 suffers by such a pressing-together in the transverse direction. It may be assumed that, when the sliver connection is established, it is not always the same point of the transport belt 6 that is used, since the transport belt has a length of approximately 6 m. Since an exchange of cans takes place approximately only once a week, the overlapping area will probably each time be situated at a different point of the transport belt 6.

Figure 6:
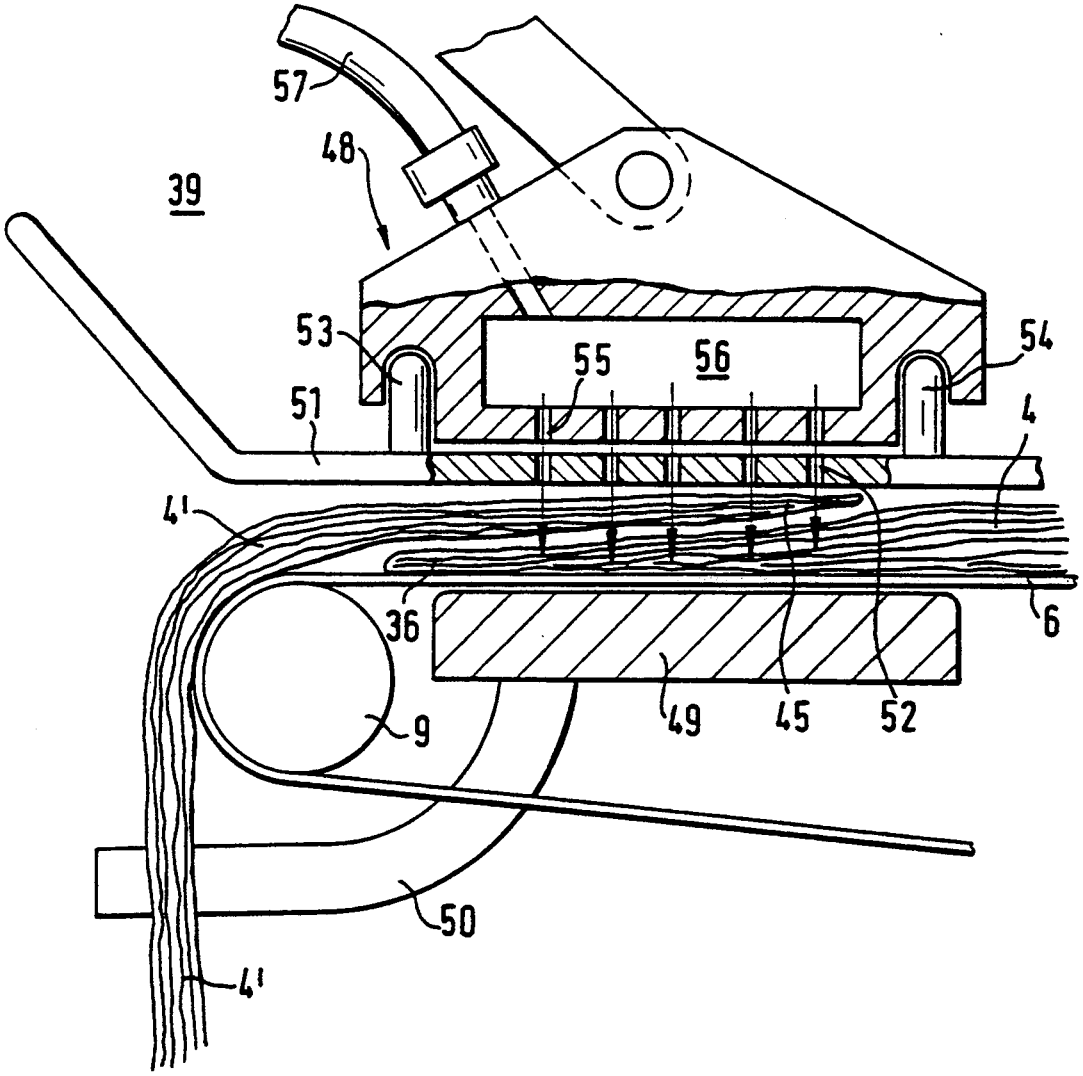
FIG. 6 is a view of actuating devices for the automatic establishing of a sliver connection, constructed according to a preferred embodiment of the invention.

FIG. 6 shows an auxiliary arrangement 48 of an automatic piecing arrangement 39 for establishing a sliver connection.

First, the end portion 36 of the old sliver 4 is prepared in the manner described above, specifically in the area of a pressure plate 49. This pressure plate 49 is provided with lateral guides 50 for the new sliver 4'.

Then the starting portion 45 of the new sliver 4' is placed on the end 36 of the old sliver 4. Then the previously lifted skid 51 is put down. On the one hand, it has a row of openings 52 as well as two centering pins 53 and 54.

The auxiliary arrangement 48 is placed on the skid 51 and pressed down. This auxiliary arrangement 48 has a row of bores 55 which coincide with the openings 52. The bores 55 start in an excess pressure space 56 which is connected to an excess pressure line 57. As soon as the auxiliary device 48 is put down, compressed air is switched on and this compressed air penetrates in a needle-type manner the overlapping area of the two slivers 4 and 4'.

As may be required, the transport belt 6 may be constructed to be air permeable. However, this is not absolutely necessary because the air can also escape to the side. If required, the pressure plate 49 may also be provided with a hollow extending in the longitudinal direction so that the slivers 4 and 4' placed above one another can be slightly pressed into the hollow—together with the transport belt 6—by means of the compressed air.

The centering pins 53 and 54 ensure that the bores 55 correspond to the openings 52.

A special advantage is also the fact that the starting portion 45 of the new sliver 4' is already placed around the deflecting roller 9. As a result of this deflection, the sliver 4' as soon as it is deposited correctly, remains in the desired position. No special securing devices are required in order to prevent a slipping of the starting portion 45 of the new sliver 4'. The skid 51 may be put down without any rush, and there is no danger that the starting portion 45 of the new sliver 4' slips away toward the rear before the skid 51 comes to rest.

Although the invention has been described and illustrated in detail, it is to be clearly understood that the same is by way of illustration and example, and is not to be taken by way of limitation. The spirit and scope of the present invention are to be limited only by the terms of the appended claims.

What is claimed:

1. A process for the piecing of a starting portion of a new sliver to an end portion of a sliver that travels into a spinning arrangement including providing a spinning machine with a transport device between a can containing sliver and a drafting unit, the transport device including a transport belt having a drive and a skid that presses the sliver against the transport belt, the drive and the skid having an inlet area, comprising:

lifting the skid off the transport belt at the inlet area of the transport belt and the skid, connecting the end portions of the slivers with one another in an overlapping and supported manner so as to form an overlapping area, placing the slivers in the overlapping area on said transport belt, placing the skid on the overlapping area, and loading the overlapped sliver by means of the skid thereby pressing the slivers onto the transport belt.

2. A process according to claim 1, comprising forming the starting portion and the end portion of the slivers to be pointed before connecting them in an overlapping manner.

3. A process according to claim 2, wherein the forming of the starting portion and the end portion of the slivers to be pointed includes clamping and drafting the portions, a remaining piece being cut off.

4. A process according to claim 2, further comprising securing at a given site the end portion of the sliver before being made pointed.

5. A process according to claim 3, further comprising securing at a given site the end portion of the sliver before being made pointed.

6. An arrangement for piecing a starting end portion of a new sliver to an end portion of a sliver that travels into a spinning arrangement comprising:

connecting apparatus for connecting the end portions with one another in an overlapping manner so as to form overlapping end portions, a transport belt for supporting the overlapped end portions, and a liftable skid for lifting off the transport belt to receive the starting end portion of the new sliver and is lowerable onto the overlapped end portions and the transport belt to press the overlapped end portions onto the transport belt.

7. An arrangement according to claim 6, comprising apparatus for tapering the end portions before being connected in an overlapping manner.

8. An arrangement according to claim 7, wherein said apparatus for tapering the end portions includes a clamping device for clamping and drafting the respective slivers.

9. An arrangement according to claim 6, further comprising a deflecting guide at the overlapping area for deflecting the transport belt in the overlapping area.

10. An arrangement according to claim 6, further comprising an actuating device that actuates a movable piecing arrangement at the overlapping area.

11. An arrangement according to claim 9 further comprising an actuating device that actuates a movable piecing arrangement at the overlapping area.

12. An arrangement according to claim 8, further comprising a deflecting guide at the overlapping area for deflecting the transport belt in the overlapping area.

13. An arrangement according to claim 12, further comprising an actuating device that actuates a movable piecing arrangement at the overlapping area.

14. An arrangement according to claim 8, wherein a movable servicing device is provided for selectively moving between respective spinning stations of a multiple spinning station machine, said movable servicing device including apparatus for selectively moving said skid away from a loading position to accommodate said overlapping of the sliver end portions to a loading position pressing said overlapped end portions against one another and the transport belt.

15. An arrangement according to claim 13, wherein a movable servicing device is provided for selectively moving between respective spinning stations of a multiple spinning station machine, said movable servicing device including apparatus for selectively moving said skid away from a loading position to accommodate said overlapping of the sliver end portions to a loading position pressing said overlapped end portions against one another and the transport belt.

16. An arrangement according to claim 6, further comprising a compressed air splicing device at the overlapping area for assisting in piecing the overlapped sliver end portions while supported between the skid and transport belt.

17. An arrangement according to claim 16, further comprising a movable servicing device for carrying the compressed air splicing device.

* * * * *